United States Patent [19]

Yamaguchi et al.

[11] 4,132,924

[45] Jan. 2, 1979

[54] SYSTEM FOR DRIVING A GAS DISCHARGE PANEL

[75] Inventors: Hisashi Yamaguchi, Kobe; Kenji Murase; Hiroyuki Ishizaki, both of Kyogo; Hirofumi Kashiwara, Kyogo, all of Japan

[73] Assignee: Fujitsu Limited, Japan

[21] Appl. No.: 856,035

[22] Filed: Nov. 30, 1977

[30] Foreign Application Priority Data

| | | | |
|---|---|---|---|
| Nov. 30, 1976 | [JP] | Japan | 51/144142 |
| Dec. 3, 1976 | [JP] | Japan | 51/145944 |
| Mar. 3, 1977 | [JP] | Japan | 52/23423 |
| Apr. 30, 1977 | [JP] | Japan | 52/50521 |

[51] Int. Cl.[2] ..... H05B 37/00; H05B 39/00; H05B 41/00

[52] U.S. Cl. ..... 340/779; 340/799; 340/803; 340/805; 315/169.2

[58] Field of Search ..... 315/169 R, 169 TV; 340/324 M

[56] References Cited

U.S. PATENT DOCUMENTS 3,944,875 3/1976 Owaki et al. ..... 315/169 TV

*Primary Examiner*—Craig E. Church
*Assistant Examiner*—Robert E. Wise
*Attorney, Agent, or Firm*—Staas & Halsey

[57] ABSTRACT

Methods and systems for driving a self-shift type of gas discharge panel utilize a plurality of basic pulse trains for the shifting of discharge spots. The pulse trains are applied cyclically and sequentially to each phase of a multi-phase display cell array, each cycle comprising several unit periods, and the array having regularity in its arrangement. This facilitates control of timing for phase switching, and accurate shift operation can be realized by variation of the basic pulse trains.

19 Claims, 17 Drawing Figures

| 0 | 1 | 2 | 3 | 4 | 5 | 6 | 7 | 8 | 9 | 10 | 11 | 12 | 13 | 14 | 15 | |
|---|---|---|---|---|---|---|---|---|---|---|---|---|---|---|---|---|
| 1 | 1 | 0 | 0 | 0 | 0 | 0 | 0 | 1 | 1 | 0 | 0 | 0 | 0 | 0 | 0 | → ① |
| 0 | 0 | 0 | 0 | 1 | 1 | 0 | 0 | 0 | 0 | 0 | 0 | 1 | 1 | 0 | 0 | → ② |
| 1 | 0 | 0 | 0 | 0 | 0 | 0 | 0 | 1 | 0 | 0 | 0 | 0 | 0 | 0 | 0 | → ③ |
| 0 | 0 | 0 | 0 | 1 | 0 | 0 | 0 | 0 | 0 | 0 | 0 | 1 | 0 | 0 | 0 | → ④ |

SYSTEM FOR DRIVING A GAS DISCHARGE PANEL

BACKGROUND OF THE INVENTION

1. Field of the Invention

This invention relates to driving a gas discharge panel with a shift or scan function for the discharge spots, and in particular, to new driving circuits and improved shifting methods for the self-shift type plasma display panel having a regularly arranged multi-phase discharge cell array.

2. Description of the Prior Art

AC driven gas discharge panels with a shift or scan function for the discharge spot are well known as "self-shift plasma display" panels. One such self-shift plasma display panel is described in detail in U.S. Pat. No. 3,944,875 to Owaki et al., entitled "Gas Discharge Device Having a Function of Shifting Discharge Spots", and an improved panel, in which the insulated cross-over configuration for connecting the shift electrodes to the buses is eliminated, is described in co-pending U.S. Patent Applications Ser. Nos. 810,747 and 813,627 to Yoshikawa et al. The basic configuration of such prior art self-shift plasma display panels includes a plurality of shift electrodes arranged with regularity on the substrates adjacent to the gas discharge space with discharge cell groups corresponding to at least three phases defined between opposing portions of electrodes, and the shift electrodes are led out to terminals via buses corresponding to the phase grouping of said discharge cells. Thus, by applying voltage pulses to these buses in a specified sequence, discharge spots generated in accordance with input data can be shifted sequentially between adjacent dischage cells.

However, in order to implement such a drive function, at least two kinds of voltage pulses are necessary, one a comparatively wide voltage pulse for shifting the discharge spot and the other a comparatively narrow voltage pulse for erasing the wall charge remaining at the discharge cell from which a discharge spot was transferred, and it is necessary to appropriately combine these voltage pulses into pulse trains and to sequentially supply them to each bus.

The method generally used to distribute these voltage pulses involves preparation of gate signals corresponding to the at least two kinds of pulses to be combined. These gate signals are prepared for each bus with individual phase, and multi-phase driving pulse trains are obtained by this gating. However, in such gate-control systems, when the number of phases or of buses to be driven increases, or if the number of pulses to be applied to each bus in every unit period increases, with prior art methods nonuniformities develop between each phase, and also the pulse train to be supplied sequentially to each phase becomes asymmetric; therefore circuit design for driving and timing control becomes very difficult. This difficulty in control arises particularly with the self-shift type gas discharge panel having the meander electrode configuration which is proposed in the above cited co-pending U.S. Patent Application Ser. No. 813,627 and which is discussed below.

SUMMARY OF THE INVENTION

Therefore, a purpose of this invention is an improved driving method for self-shift type gas discharge panels having a plurality of discharge cells to be driven by multi-phase voltage pulse trains.

Another purpose of this invention is a drive circuit with a simple configuration which can easily control a multi-phase driven electronic apparatus such as the self-shift plasma display.

Another purpose of this invention is an improved shift method which can stably and accurately shift the discharge spots with a large operating margin.

A further purpose of this invention is a method and circuit for driving a self-shift type gas discharge panel having a meander electrode arrangement.

The self-shift driving system of this invention involves preparation of a plurality of basic pulse trains which are sequentially supplied to the phase groups of discharge cells, involving a cycling of the basic pulse trains which are applied to each bus during each of the unit periods of each cycle. This concept is particularly effective for driving the self-shift type plasma display panel. Moreover, this method can also be adapted to drive various scan type display panels having a plurality of light emitting elements and other electron devices of the multi-phase type involving the shifting of charged particles. The timing for generating each basic pulse train is preferably generated by the output of a read-only memory (ROM) which is addressed by a counter output, and the corresponding driving waveform can be selected to maximize the operating margin.

Other purposes and features of this invention become apparent from the description of the preferred embodiments.

DESCRIPTION OF THE PREFERRED EMBODIMENTS

The configuration of the panel to be driven will be explained prior to explanation of the driving methods and systems of this invention. FIGS. 1 A and B show, respectively, in plan view of a major portion of, and in sectional view along the line B–B', the electrode arrangement in the self-shift type gas discharge panel described in co-pending U.S. Patent Application Ser. No. 813,627, cited above. In these figures, two typical shift channels SC1 and SC2 are shown along the lines of the arrows. In relation to both figures, on substrate 1 are the first electrode group x11, x12 . . . , the second electrode group x21, x22 . . . , and write electrodes W, the groups being alternately connected to the two bus conductors X1 and X2, while on the other substrate 2, similarly connected to the two bus conductors Y1 and Y2, are the third electrode group Y11, Y12 . . . , and the fourth electrode group y21, y22 . . . . The two groups of electrodes are arranged alternately on each substrate with each electrode on one substrate opposing portions of two electrodes on the other substrate, as shown. Each electrode surface is coated with a dielectric layer comprising low melting point glass 3 and 4, and the discharge gap 5 is filled and sealed with a mixed gas of neon and a small amount of xenon with a Pd (pressure times gap distance) value of about 4 to 5 Torr-Cm.

Figure 1A:
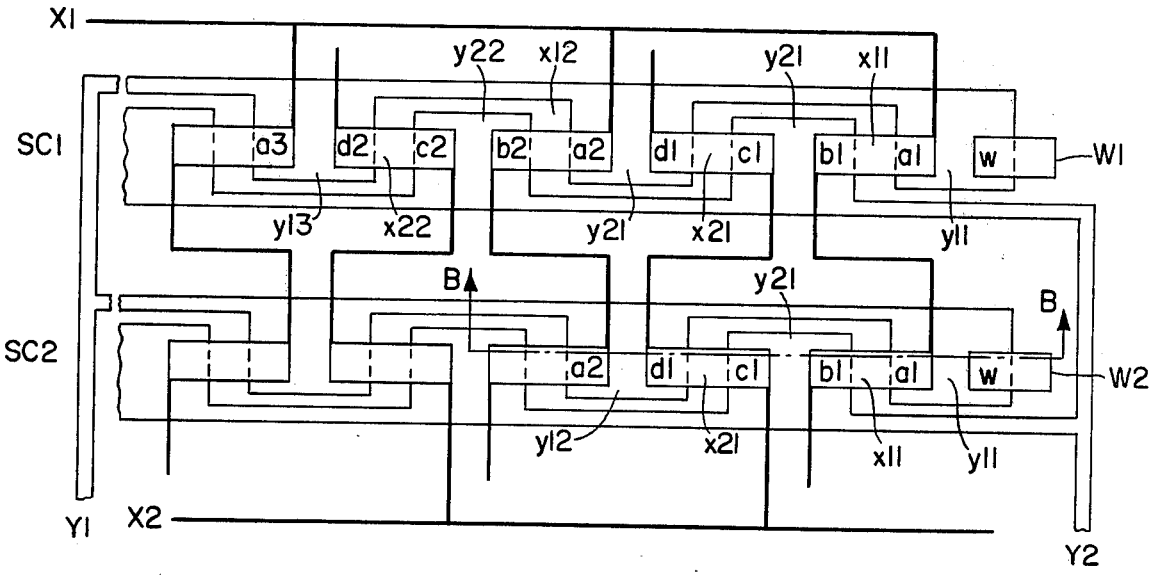
FIGS. 1 A and B show respectively a partial plan view and a section along the line B–B′ of the self-shift type plasma display panel with a meander type electrode arrangement.

Thus, in said sealed gas gap 5, four kinds of discharge cells (discharge sites) ai, bi, ci, and di (i=1,2, . . . ) correspond to combinations of phase of the 2 phase groups of periodically defined electrodes on each substrate. The discharge spot generated at the write discharge cell w in accordance with the data input to the write electrode can be sequentially shifted to the adjacent discharge cell by applying voltage pulses on the bus conductors X1, X2, and Y1, Y2, and generally two pulses are applied, on both X and Y sides, to implement the sequential switching operation. As shown in FIG. 1A, each of the four electrode groups defining the discharge cells has a meander type electrode arrangement. Hereafter a gas discharge panel of this type is referred to as a "M type self-shift panel".

The above mentioned M type self-shift panel has two bus conductors on each substrate and the discharge spot is shifted or scanned by driving with pulse trains of 2 by 2, or 4, phases. There are no crossover points of the buses on each substrate to be insulated. Each discharge cell has one electrode in common with the opposing two adjacent discharge cells. The waveform and phase of each of the pulse trains and the timing of the switching have an influence on adjacent discharge cells at the time of electrode driving.

Figure 2:
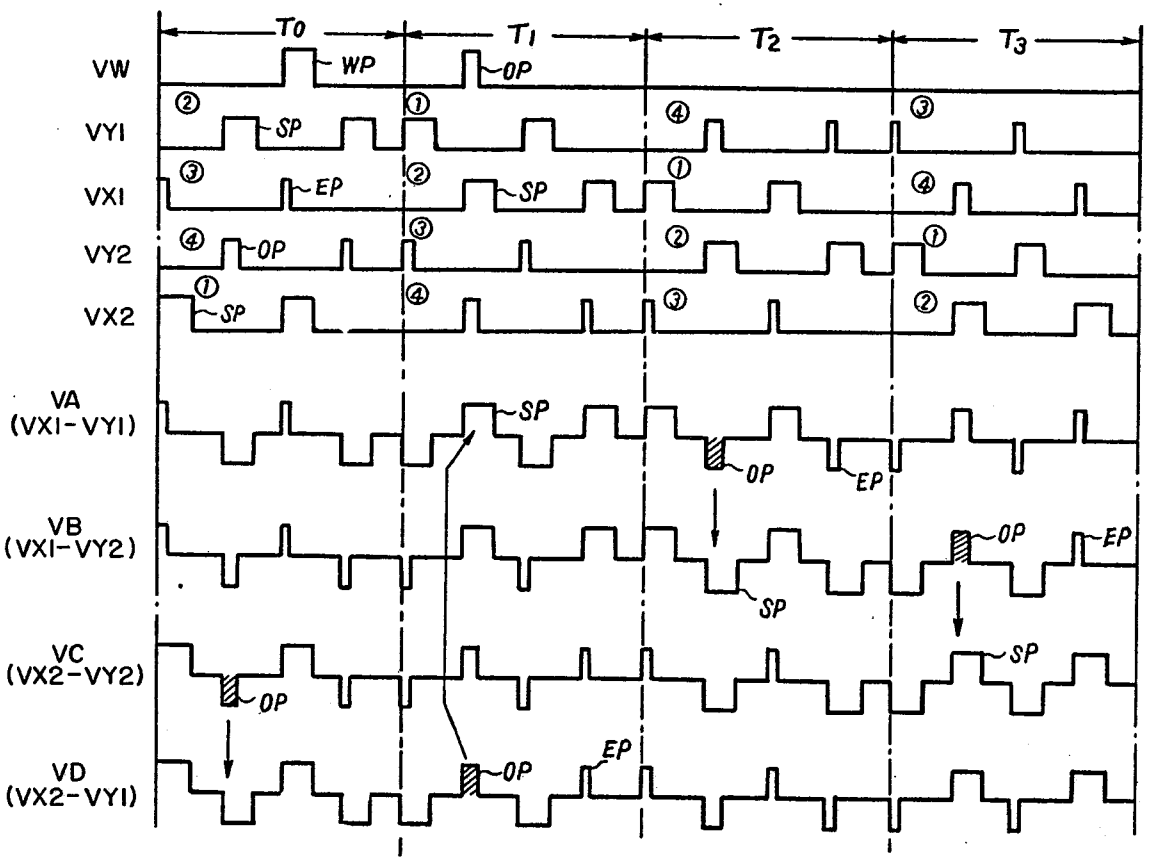
FIG. 2 shows a set of driving waveforms for the self-shift plasma display panel of FIG. 1.

FIG. 2 shows a set of driving waveforms for said M type self-shift panel. In this figure, VW is the write voltage waveform applied to the write electrode w; VY1, VX1, VY2 and VX2 are the driving waveforms for each phase group which are applied to the corresonding bus conductors Y1, X1, Y2 and X2; and VA, VB, VC, and VD are the resulting voltage waveforms applied across the four groups of discharge cells, with positive polarity for those from the X side and negative polarity for those from the Y side. It should be particularly noted in FIG. 2 that the basic pulse trains (denoted by the numbers in circles) supplied to each phase group are sequentially cycled at each unit period T0, T1, T2 and T3 of the cycle,, the cycle period being the sum of the unit periods.

Figure 3A:
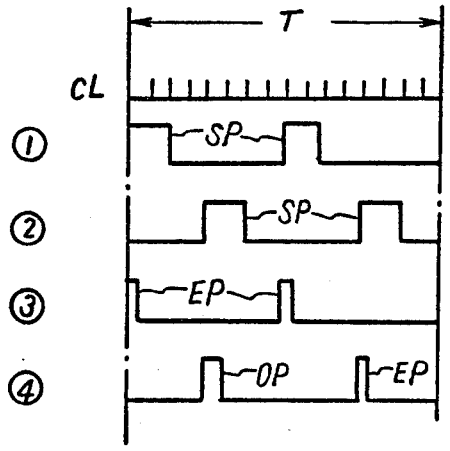
FIGS. 3 A and B show respectively the basic pulse trains for each unit period and their sequencing during each cycle of driving.
Figure 3B:
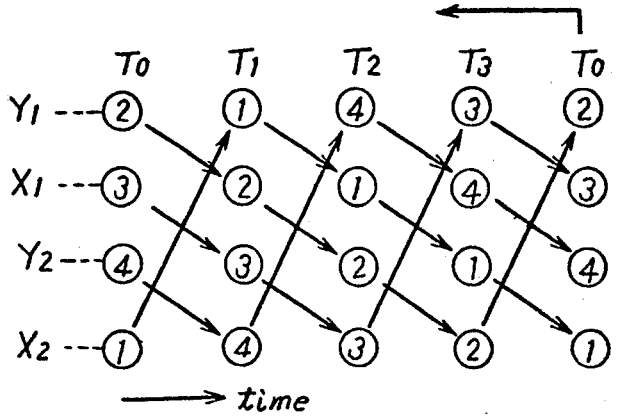

The three kinds of voltage pulses SP, EP and OP necessary for self-shift operation are prepared, as in the basic pulse trains 1 to 4 shown in FIG. 3A, corresponding to the four phase groups. These pulse trains are cycled in every unit period, as shown in FIG. 3B, and each basic pulse train is sequentially applied to each bus Y1, X1, Y2, X2. The shift pulse SP has a comparatively wide time width of 5 to 10 usec, and acts also as the sustain pulse for sustaining the discharge spot during display. The erase pulse EP has a narrow time width of about 1 usec or less, for example, and erases the wall charge remaining on the dielectric layer of a discharge cell after transfer of the discharge spot to an adjacent cell. The control or overlap pulse OP has a comparatively narrow time width of about 2 usec, although it assumes the same waveform as the abovementioned shift pulse in some cases. This overlap pulse is applied to the one electrode of the discharge cell from which the discharge spot is being transferred, said one electrode not being in common with an electrode of the cell to which the discharge spot is being transferred. The timing of pulse OP overlaps with the shift pulse SP which is applied to the non-common electrode of the cell to which the discharge spot is moving. In addition, this overlap pulse is useful for improving the shift operating margin as proposed in co-pending U.S. Application Ser. No. 782,454.

Figure 1B:
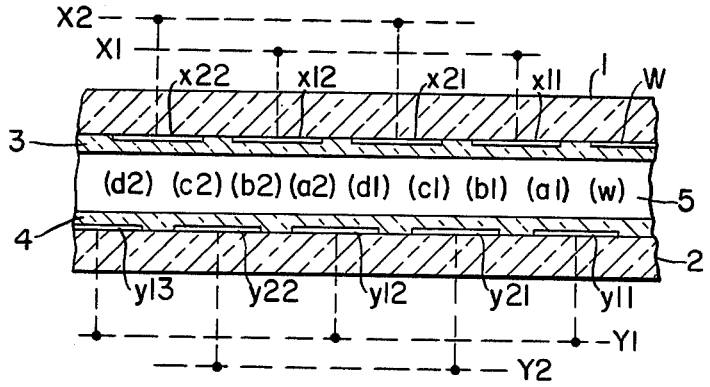

This shift operation is explained in reference to FIGS. 2 and 1B wherein the arrows show the timing of the shift operation of the discharge spot between the discharge cells indicated. By supplying the write pulse WP of writing waveform VW in unit period T0, a discharge spot is generated at the write discharge cell W in the gap area between write electrode w and electrode y11 of the phase group corresponding to bus Y1. Then, when the overlap pulse OP is supplied to the write electrode w at the time the shift pulse SP is applied to the electrode x11 in the phase group of bus X1 in the succeeding unit period T1, the initially written discharge spot is shifted to the adjacent discharge cell a1 defined between the electrodes y11 and x11. In the unit period T2 of the next portion of the cycle, the overlap pulse OP is applied to the electrode y11 via the bus Y1 and the shift pulse SP is applied to the electrode y21 via the bus Y2. Thus, the discharge spot is shifted to the adjacent discharge cell b1.

As explained above, the basic pulse train applied to the phase group of each bus is sequentially cycled, each such basic pulse train being sequentially cycled at the unit periods T0, T1, T2, T3, T0 . . . in the cycle of period T0 through T3 for shifting the discharge spots. Data may be simultaneously written in each cycle period, and as the data is shifted along the ith group of electrodes ai, bi, ci, and di, one of the four discharge cells of this ith group of cells always has the data in the form of a discharge spot. During this cycle, the erase pulse EP is automatically applied to each discharge cell from which a discharge spot was transferred according to the above mentioned phase cycling, and there is no fear of causing an erroneous discharge as a result of any discharge corresponding to preceding data, even when the shift pulse of a unit period following one cycle is applied again via the common bus.

Figure 4:
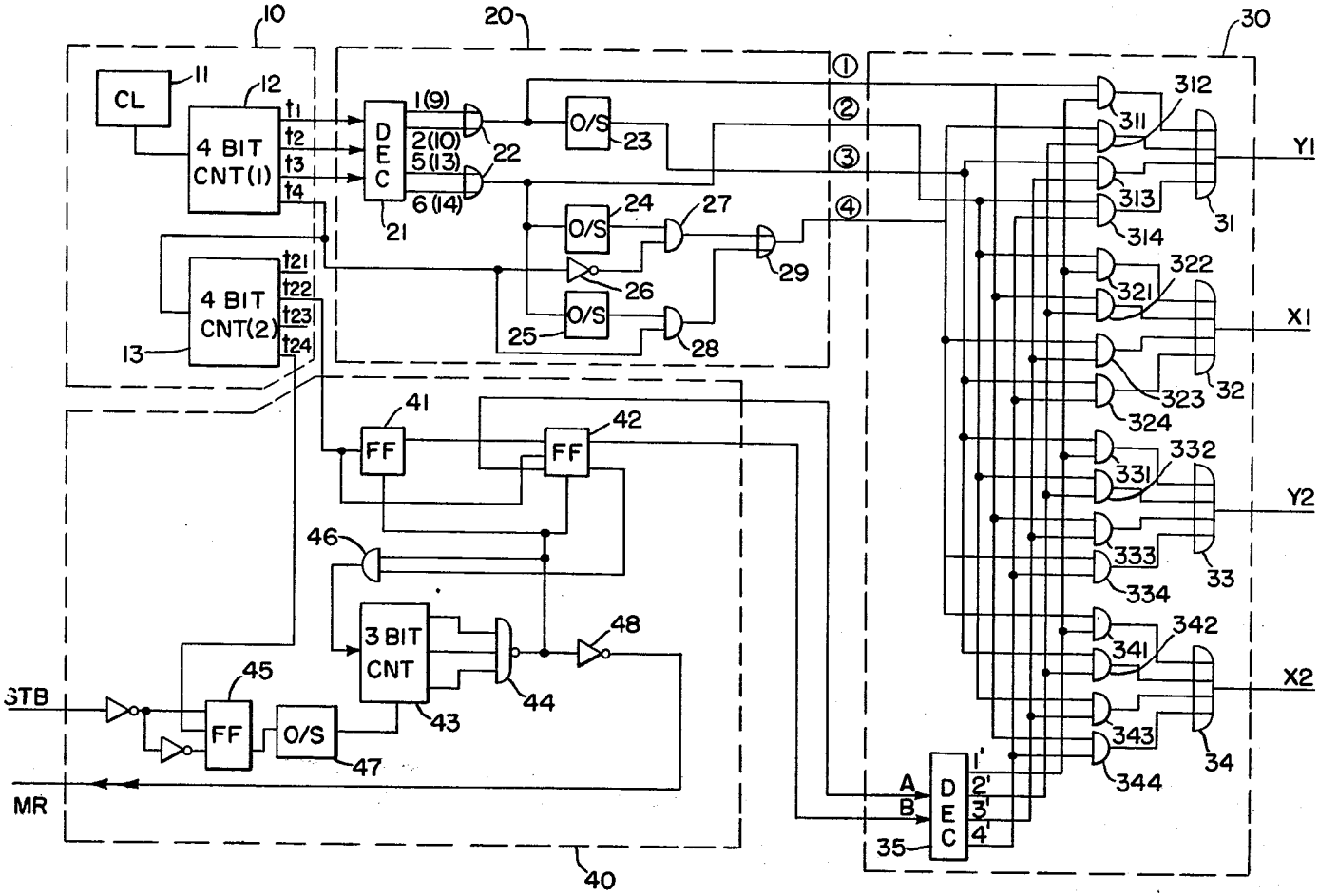
FIGS. 4, 5 and 7 show in block diagram various driving circuits for the self-shift type of display panel of FIG. 1.

FIG. 4 shows in block diagram an embodiment of driving circuit for the driving method of the M type self-shift panel. This driving circuit generally comprises the counter circuit unit 10, the basic pulse train generating circuit unit 20, the cycling circuit unit 30 and the control circuit unit 40. The cycling and control circuit units serve to distribute the output of the basic pulse train generating circuit unit. The control circuit can also serve to coordinate the writing of data into the panels. Portions of the counter circuit unit may be considered generally as part of generation or control circuit means, as appropriate or convenient.

The counter circuit unit 10 comprises the clock pulse generating circuit 11 and two binary 4-bit counters 12 and 13. The outputs t1, t2, and t3 of the three lower order bits of the first 4-bit counter 12 are input to the 8-line decoder 21 of the basic pulse train generating circuit unit 20. Thus, from the outputs of said 8-line decoder 21, the signals corresponding to the 1st (or 9th) and 2nd (10th), 5th (13th) and 6th (14th) counting output can be extracted through the two OR gates 22, the counting output of said three lower order bits cycling twice during each unit period of the 16-counting outputs of the 4-bit counter 12. The signal corresponding to the 1st (9th) and 2nd (10th) counting outputs results in the shift pulses SP of basic pulse train 1 as shown being supplied to conductor line 1, in the unit period of FIG. 3A, and these same counting outputs also result in the narrow width pulse corresponding to the erase pulse EP of basic pulse train 3 in the unit period shown in FIG. 3A to conductor line 3 via the one shot multivibrator 23.

The signal corresponding to said 5th (13th) and 6th (14th) counting outputs is also divided into two signals. The pulse corresponding to the shift pulse SP of basic pulse train 2 in said FIG. 3A is output to conductor line 2, said basic pulse train 2 being identical with but having a phase shift of 180° from said pulse train 1. Similarly, such signal is input to each of the two one shot multivibrators 24 and 25 for generating the overlap pulse OP and erase pulse EP in basic pulse train 4, as shown in FIG. 3A. The one one-shot multi-vibrator 24 outputs the overlap pulse having a predetermined time width and which rises in correspondence with said 5th count signal to the conductor line 4 via the AND gate 27 which is in the ON condition until the second repetition of the 8-counting output is obtained by inverting the 4th bit output t4 of the 4-bit counter 12 with the inventer 26, namely, during the first half of each unit period, and the other one-shot multi-vibrator 25 outputs the narrow erase pulse EP which rises in correspondence with the 13th count signal in the second half of each unit period of the conductor line 4 via the AND gate 28 which is opened during the second repetition of the output by means of the 4th bit output t4 of the 4-bit counter 12.

The above mentioned four conductor lines 1 to 4 are respectively connected as indicated in FIG. 4 to one input of AND gates 311 to 314, 321 to 324, 331 to 334 and 341 to 344, forming four groups each having four gates, in the cycling circuit unit 30 in correspondence with the four phase bus conductors Y1, X1, Y2, X2 of the above mentioned M type self-shift panel. Each phase output is respectively connected to not-illustrated shift drivers of said bus conductor via the OR gate 31 to 34. In addition, the other inputs of said each AND gate group are connected as shown in FIG. 4 to four outputs of the 4-line decoder 35, and the pulse trains from the conductor lines 1 to 4 are sequentially cycled to the shift drivers connected to bus conductors Y1, X1, Y2 and X2, by means of the output from said decoder 35.

Meanwhile the control circuit unit 40 has flip-flops 41 and 42 in a 2-stage shift register configuration which operate with the lowest order bit output t21 of said 2nd 4-bit counter 13 included in the counter circuit unit 10, and the output of each stage is input to the aforementioned 4-line decoder 35 as the cycling switching signals A, B. Accordingly, since the signal which rises at the 16-counting of the basic clock and falls at the 32-counting is derived from the 1st bit output t21 of the 2nd counter 13, which counts the 4th bit output signal t4 of the 1st counter 12 or in other words which counts every 16 countings of the clock pulses, therefore the cycling signal which switches the basic pulse trains in the sequence of 1', 2', 3' and 4' at every unit period is sequentially read out. Thereby, the driving waveforms for the bus conductors Y1, X1, Y2, X2 can be generated as explained above.

The control unit 40 includes the binary 3-bit counter 43 which counts the output of flip-flop 42, the 2nd stage of the shift register. This 3-bit counter is not directly related to the subject of this invention, but shows the control of character writing, for example a pattern of 5 × 7 dots in this case. Namely, as described above, in the M type self-shift panel, one discharge cell in each group of 4 adjoining cells sustains data in the form of a discharge spot, because the cycle of shift operation has four unit periods. If one character pattern requires five cycles across seven shift channels, and if a spacing of 2 lines is desired between characters, then the timing of writing the next character would correspond to the 8th cycle. For this purpose, entry of this new character is controlled with the output of said 3bit counter 43.

When the 3-bit counter 43 counts up 8 and the outputs become all "1", counting input from the flip-flop 42 is stopped at the AND gate 46 by the output of NAND gate 44. Then said counter 43 is reset by the 4th output t24 of the 2nd 4-bit counter 13 and the output of the one-shot multi-vibrator 47 answering to the strobe STB, and simultaneously the signal which enables writing of the next character is sent to a not-illustrated write control circuit via the line MR.

The driving circuit of FIG. 4 described above is very useful for explaining the principle of this invention, but the circuit configuration is a little complicated. Therefore, another embodiment will be described below, where the circuit configuration is simplified by employing a ROM (read-only memory) for the basic pulse train generating circuit unit.

Figures 5, 6:
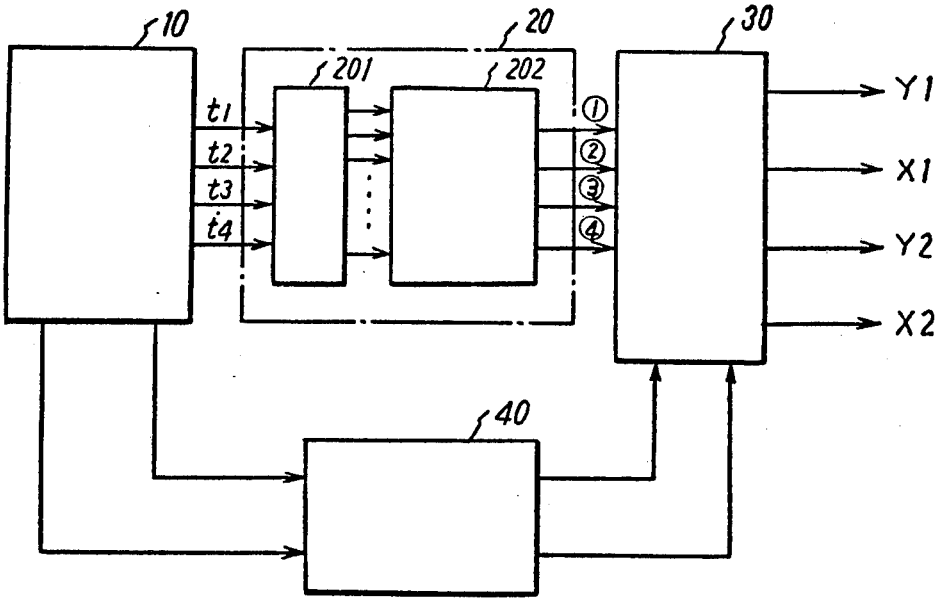
FIG. 6 shows the memory content of the read-only memory for the circuit of FIG. 5.

FIG. 5 is a block diagram of such an embodiment and reference symbols for the units shown correspond to circuit units of FIG. 4. In FIG. 5, the ROM 202 forming the basic pulse train generating circuit unit 20 has, for example, a 4 × 16 bit configuration as shown in FIG. 6. The 4-bit output t1 to t4 of the counter circuit unit 10 is input to the address decoder 201 and then the timing signals are read out sequentially in 4-bit parallel form from the ROM 202. Therefore, the pulse trains 1 to 4 of the unit period shown in FIG. 3 can be obtained from the addresses 0 to 15. The pulse trains 1 to 4 are distributed to shift drivers not illustrated connected to the buses Y1, X1, Y2, X2. Thus the basic pulse trains are sequentially cycled in accordance with the signal from the control circuit unit 40 to the cycling circuit unit 30.

The phase relation of the pulse trains in each unit period can be set more precisely by further increasing the number of bits of this ROM 202. In such case, the number of bits of the counter of the counter circuit unit 10 is of course increased. The read-only memory ROM 202 may be constructed as PROM (programmable read-only memory) to allow modification of the basic pulse trains by easily changing or replacing the content of the ROM 202. Moreover, by using the ROM constructed as an integrated circuit, the basic pulse train generating circuit unit 20 can be easily and drastically mineaturized.

Figure 7:
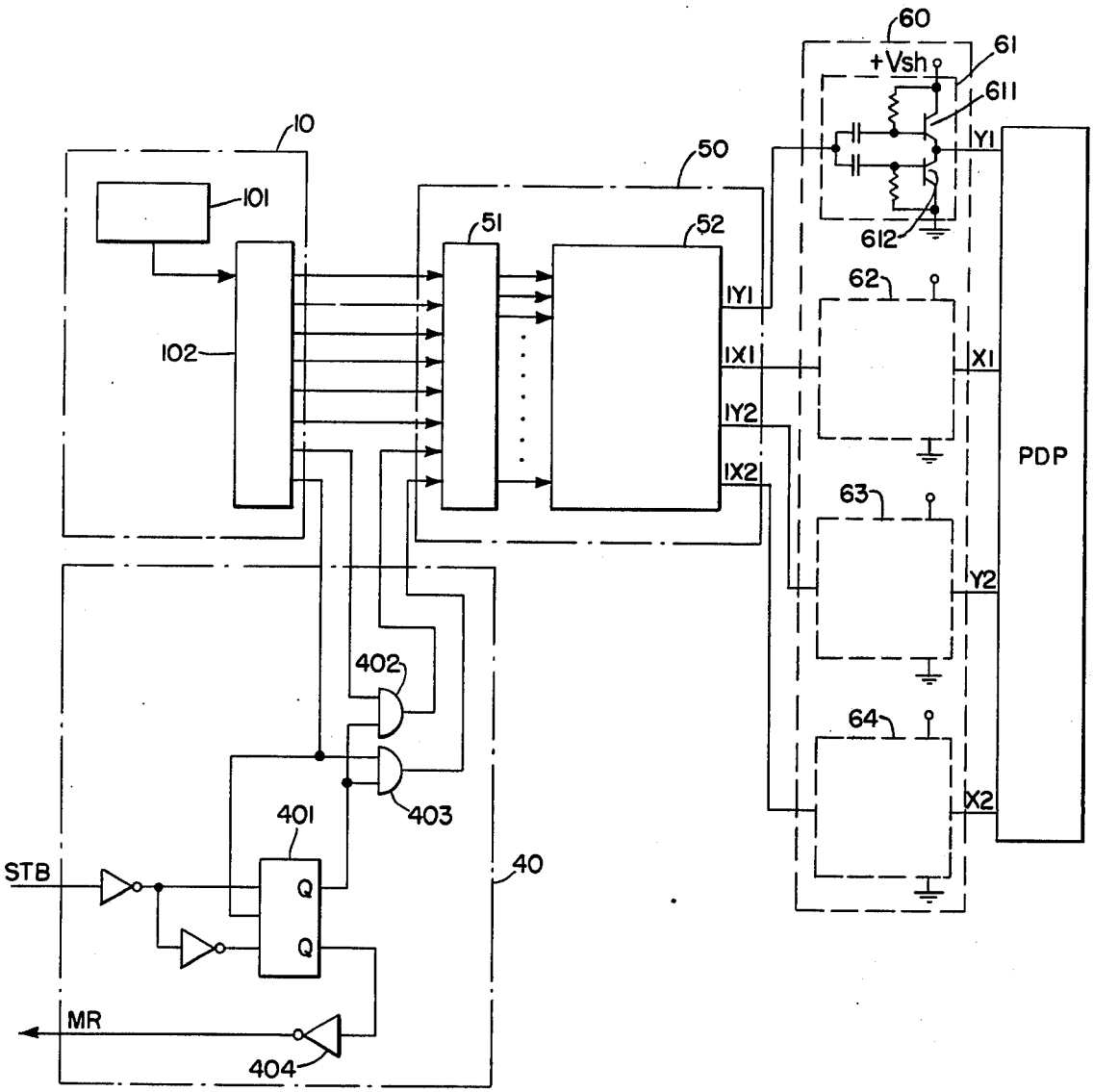
Figure 8:
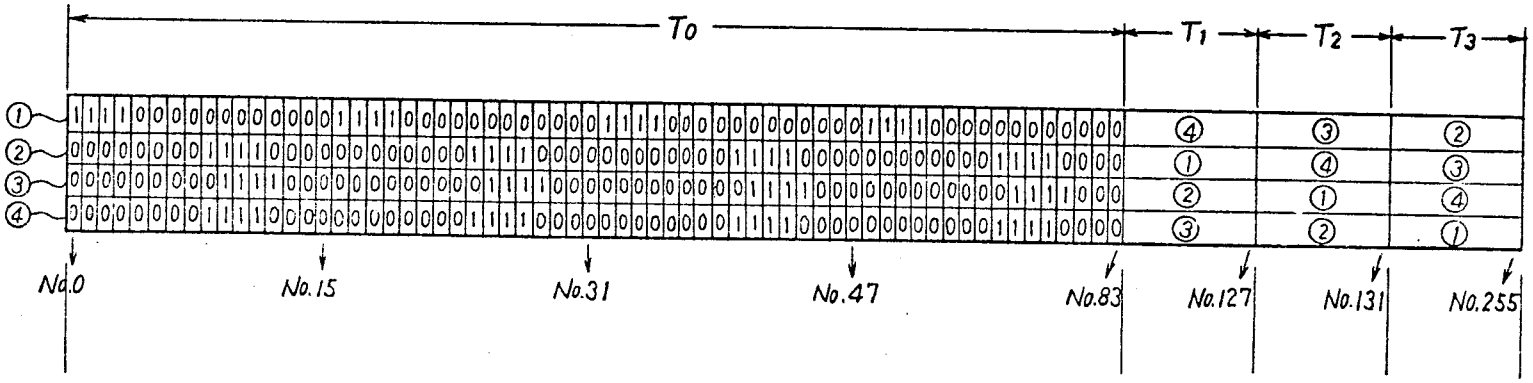
FIG. 8 shows the memory content of the read-only memory for the circuit of FIG. 7.

Furthermore, as another embodiment, said basic pulse train generating circuit unit 20 and said cycling circuit unit 30 can be formed with a single ROM, as shown in FIG. 7. The counter circuit unit 10 comprises the clock generator 101 and 8-bit counter 102, the control circuit unit 40 comprises the flip-flop 401, AND gates 402 and 403, and inverter 404, and the pulse train generator circuit unit 50 comprises the address decoder 51 and ROM 52. ROM 52 has a configuration of 4 × 256 bits, for example, with memory content as shown in FIG. 8. The content of addresses 0 to 63 is for the unit period T0 and the sequence of applying basic pulse trains 1 to 4 is interchanged as shown in the figure in the other unit periods T1 to T3. The driving pulse voltage for the panel PDP is supplied to the buses by connecting terminals.

When the strobe signal STB is set to "0" to determine the shift mode, the flip-flop 401 is in the set condition and the output of the 8-bit counter 102 is applied to the address decoder 51. Therefore, the content of the address from 0 to 255 of ROM 52 shown in FIG. 8 is sequentially read out and cyclically applied to the buses Y1, X1, Y2, X2.

When the strobe signal STB becomes "1" to designate the display mode, since the flip-flop 401 is reset when the highest bit output of the 8-bit counter 102 becomes "1", the AND gates 402 and 403 are closed and the 6 lowest order bit outputs of the 8-bit counter are applied to the address decoder 51. Therefore, the unit period T0 is repeated and the static display mode results.

In the configuration of FIG. 7, the driving waveforms IY1, IX1, IY2 and IX2 read out from ROM 52 of circuit unit 50 are applied to the shift driver unit 60 including shift drivers 61 to 64 corresponding to each bus as the basic timing signals. One such driver 61 is shown, and each driver typically includes a pair of transistors, such as up-transistor (pnp) 611 and down-transistor (npn) 612 connected between the power source of $V_{sh}$ and ground potential, each transistor being driven selectively by the common inverted timing signal IY1.

Figure 9:
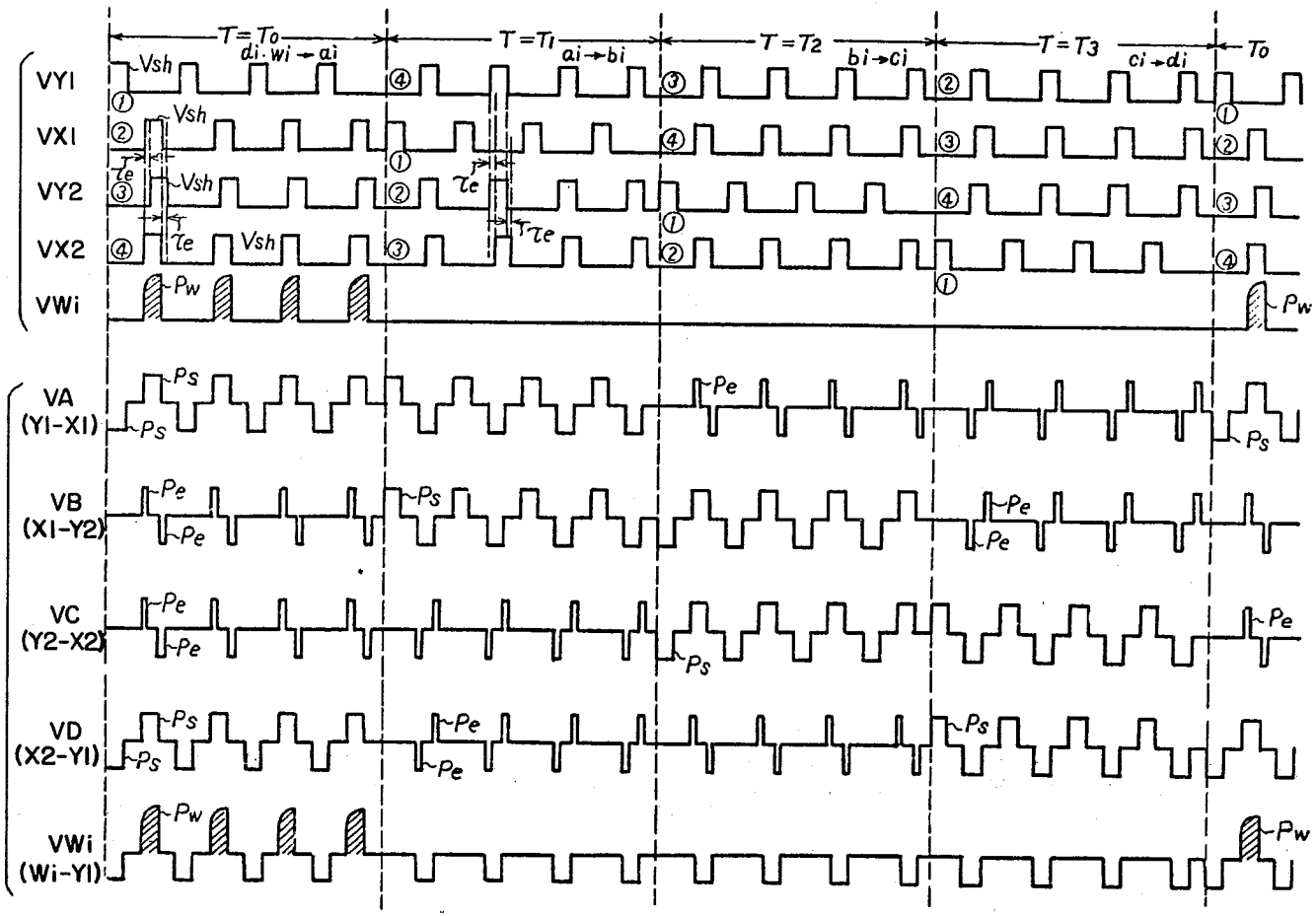
FIG. 9 shows a set of driving waveforms produced by the circuit shown in FIG. 7 for operation of the self-shift plasma display panel of FIG. 1.

FIG. 9 shows the driving waveforms in the shift mode of operation, resulting from the stored content of ROM 52 as shown in FIG. 8, for driving the M type self-shift panel indicated by FIG. 1. In FIG. 9, VY1, VX1, VY2, and VX2 represent driving waveforms to be respectively applied to buses Y1, X1, Y2, X2 as in FIG. 2, and VWi indicates the write voltage waveform applied to the write electrode Wi. Voltage waveforms VA, VB, VC, and VD represent the resultant voltages applied across the four groups of discharge cells ai, bi, ci, and di, as the composite of the writing waveforms applied to each bus conductor. Note the polarity convention differs from that of FIG. 2, as indicated by FIG. 9. Vwi represents a composite voltage waveform applied across the write discharge cell Wi.

As is shown in FIG. 9, to each of the bus conductors Y1, X1, Y2, and X2 are sequentially cycled the four basic pulse trains 1, 2, 3, and 4 at each unit period in predetermined order, in such a manner that the four unit periods have a cyclic relation. In this case, all pulses of the four basic pulse trains have a positive polarity and the same pulse width, two conditions different from those shown in FIG. 2, with voltage value set to the shift voltage level Vsh. The four basic pulse trains have the phase relationship that pulse trains 2 and 4 are in phase, and both are 180 degrees out of phase with pulse train 1, while pulse train 3 has a time delay equal to the duration e of an erase pulse, with respect to the pulse trains 2 and 4. Thus, when the pulse train 3 is applied to one electrode of a discharge cell and pulse train 2 or 4 is applied to the other, a pair of erase pulses Pe of shorter duration result across the cell corresponding to this phase delay between those pulse trains.

The initial discharge spot is generated in unit period T0 of FIG. 9, for example, when the write voltage pulse Pw is repeatedly applied to the write electrode wi to cause a write voltage waveform such as Vwi at the write discharge cell of the ith shift channel. During this unit period T0 the shift voltage pulse Ps of voltage waveform VA is repeatedly supplied along bus conductors Y1 and X1 across this phase group of cells, including the first discharge cell a1 beyond the write cell in each shift channel. The priming effect of the discharge spot in the discharging write cell of the ith shift channel, together with voltage waveform VA, causes a discharge spot to be developed in this unit period at the discharge cell of the group a1 adjacent to the write discharge cell wi in the ith shift channel. During this unit period T0, a shift voltage pulse such as Vsh of driving waveform VY2 is supplied along bus conductor X2 to discharge cells of the group d containing data in the form of discharge spots written into the write cells in prior cycles. Thus there arises a mode in which discharging cells of the group d and the discharging cells of the adjacent group a have adjoining discharge spots, representing information written in a cycle before the writing of the ith write cell above. During the period T0, across the discharge cells of the remaining groups b and c are applied a pair of erase pulses Pe of narrow width resulting from the phase difference between pulse train 3 applied through bus conductor Y2 and pulse trains 2 and 4 applied through bus conductors X1 and X2, respectively.

The cycling of the basic pulse trains supplied to bus conductors Y1, X1, Y2, and X2, from basic pulse trains 1, 2, 3, and 4 during the unit period T0 to 4, 1, 2, and 3 during the unit period T1, respectively, causes the voltage waveform VB to be applied as shown across a discharge cell of the group b. Thus, a discharge spot at a discharge cell of the group a is shifted to the adjacent discharge cell of the group b and is thus shared by these two adjacent cells. In the meantime, across the discharge cells of the group d which may have been holding any discharge spots representing other written data is applied an erase pulse of narrow width resulting from the phase difference between basic pulse trains (3) and (4) of VX2 and VY1 as shown by the waveform VD as applied during the period T1, thus erasing any wall charge remaining on the dielectric layer. During this period, an erase pulse of narrow width also results across the discharge cells of the group c.

During a further period T2, the order of the basic pulse trains cycles to 3, 4, 1 and 2 as shown in FIG. 9, so that shift voltage pulses are applied accross the discharge cells of the groups c and b. Thus, the discharge spot is again shifted one phase and is shared by the adjacent cells of the groups b and c. After the shift of the discharge spot, a narrow width erase pulse is then applied to the discharge cells of the group a and the discharge cells of the group d to which the discharge spot is next to be shifted. During the next unit period T3, the basic pulse trains take the order 2, 3, 4 and 1, and a similar shift operation takes place.

In accordance with the preferred embodiment of the invention shown in FIG. 7, each the four basic pulse trains with equal pulse widths and voltage levels are sequentially distributed on the basis of the output of ROM 52 to each of bus conductors Y1, X1, Y2, and X2 within one cycle of four unit periods T0 to T3, and the shift operation occurs when the narrow width erase pulse, resulting from a phase difference between the four basic pulse trains, is effectively applied to the discharge cell from which the discharge originated, i.e. the source cell. In this case, the shifting of the discharge spot involves the simultaneous sharing of the discharge by two adjacent discharge cells.

Therefore, in this embodiment, the necessity of directly supplying the narrow width erase and overlap pulses is eliminated, and thus inexpensive and simple circuitry can be used without much consideration for switching speed of the driving transistor.

The driving pulse waveforms shown in FIG. 9 are different from those shown in FIG. 2, as described above, in that each written data bit is represented by discharge at two adjacent cells, instead of using a narrow width overlap pulse to restrict the discharge to one cell at a time, and in that the narrow width erase pulse results from the phase difference of wider voltage pulses supplied to opposing electrodes.

When the driving method for the M type self-shift panel is evaluated by experiment, the double cell shifting system shown in FIG. 9 is superior to the single cell shifting system shown in FIG. 2 in that a wider operating margin can be obtained and in that configuration and control of the driving circuit are simple. However, driving signal waveforms may be matched with panel characteristics, in that variation of the waveforms may maximize operating margin, and for such modification of waveform the cyclic driving system of this invention is very effective.

Figure 10:
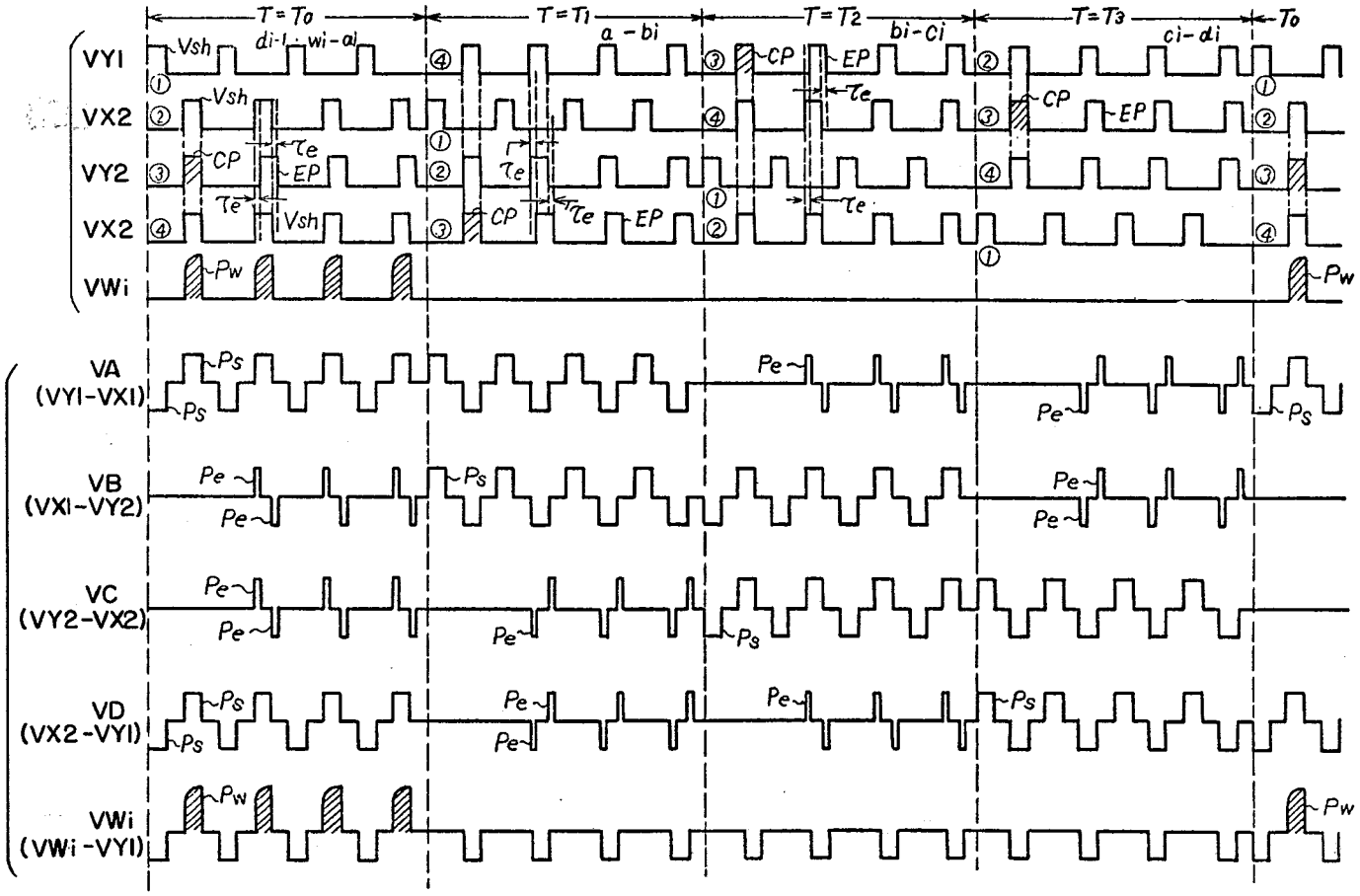
FIG. 10 shows an improved set of driving waveforms for operation of the self-shift plasma display panel of FIG. 1.

FIG. 10 shows a modification of driving pulse waveforms, with reference symbols and basic shift operation corresponding to those of FIG. 9. By contrast one pair of the erase pulses Pe of FIG. 9, which is applied to the discharge cell after shifting of the discharge spot, is cancelled due to one pulse CP of wavetrain 3 not having the phase delay $\tau_e$ with respect to wave trains 2 and 4.

Figure 11:
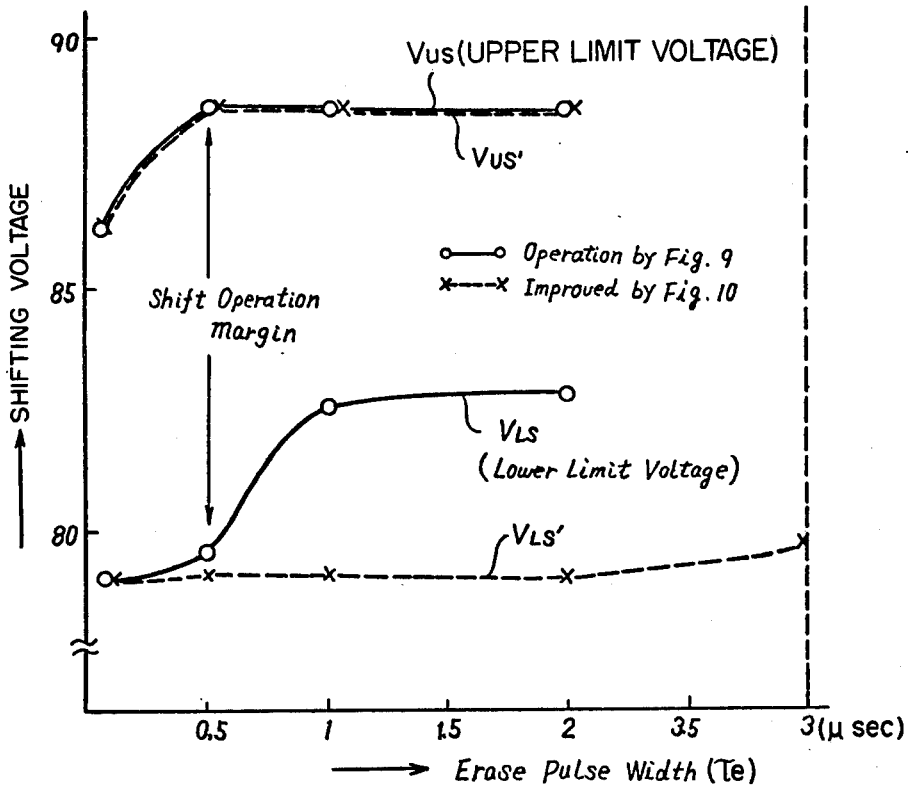
FIG. 11 shows the influence of the waveforms of FIGS. 9 and 10 on operating margin.

In general, the stability of operation of a self-shift plasma display panel is expressed in terms of the range of useable shift voltage, namely the shift margin, which depends not only on the panel structure but also on driving signal waveform. For example, by experiment it has been shown that if a driving signal waveform as shown in FIG. 9 is used, the shift margin is maximized when the effective pulse width of the erase pulse applied to the discharge cell after shifting is 0.5 usec. The upper limit voltage of the shift margin decreases when pulse width becomes narrower, and the lower limit voltage increases when pulse width becomes wider, either change from the optimal pulse width thus decreasing the shift margin. FIG. 11 shows the dependence of shift margin on erase pulse width, with the erase pulse width $\tau_e$ shown on the horizontal axis, and the shift voltage $V_{sh}$ on the vertical axis. The upper and lower limit values of the shift voltage corresponding to each erase pulse width using the driving waveforms of FIG. 9 are indicated by the curves $V_{US}$ and $V_{LS}$ respectively.

However, use of the driving waveforms of FIG. 10, where the first pair of erase pulses is effectively canceled, drastically decreases the dependence of the shift margin on pulse width. FIG. 11 shows the improvement in the shift margin between the upper limit voltage curve $V_{US}'$ and the lower limit voltage curve $V_{LS}'$ indicated by the dotted curves, and particularly the flat lower limit voltage contributes to stability of operation.

The reason why the margin is improved by the driving signal waveforms shown in FIG. 10 for the M type self-shift plasma display is now explained. FIGS. 12 A and B depict conditions of discharge between two adjacent discharge cells in comparison of the driving waveforms of FIGS. 9 and 10, respectively.

Figure 12A:
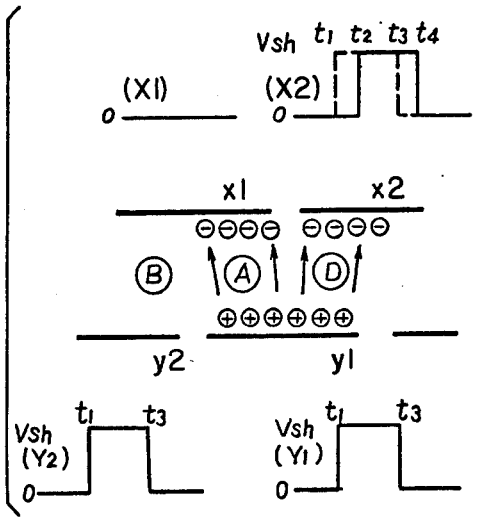
FIGS. 12 A and B show the relation between internal condition of the discharge cell and applied voltage for shift operation using the waveforms of FIGS. 9 and 10 respectively.
Figure 12B:
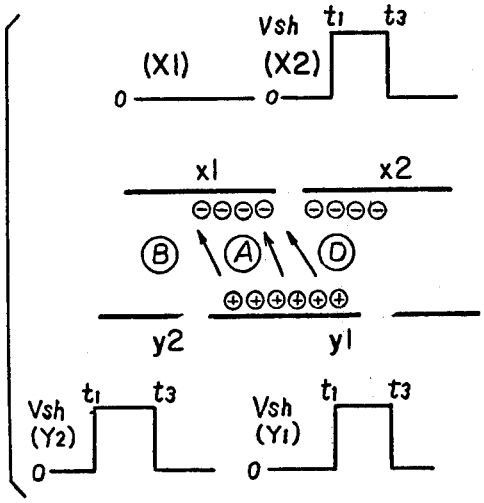

FIG. 12A shows the shift operation for shifting the discharge spot at discharge cells D and A, having the electrode y1 in common, to the next pair of discharge cells B and A, which shift occurs at the beginning of unit period T1. The shift pulse voltage $V_{sh}$ is applied simultaneously to electrodes y1 and y2, in order to generate the discharge spot at the adjacent discharge cell B by the plasma coupling accompanying the discharge at cell A. The shift pulse voltage $V_{sh}$ applied to X2 at time t2, has a different phase from the shift pulse voltage supplied to electrode y1 at time t1, the electrodes y1 and x2 defining the discharge cell D to be erased. If the phase difference (t2−t1) or (t4−t3) corresponding to the erase pulse width becomes long, a part of the space charge generated at the discharge cell A is pulled to the discharge cell D wherein the wall charge remains as a result of having been the site of a discharge, and the supply of charge to discharge cell B to which the discharge is to be shifted is reduced.

Therefore, as explained for FIG. 11, when the erase pulse is applied to cell D immediately after the shifting, the lower limit voltage of shift margin $V_{LS}$, namely the voltage causing discharge at the adjacent discharge cell to which the discharge spot is to be shifted by means of plasma coupling, becomes high as the pulse width of the erase pulse becomes wide.

However, with the driving waveforms shown in FIG. 10, the first pair of erase pulses are eliminated because the pulse voltages are simultaneously applied to both electrodes of the discharge cell from which the discharge was shifted, as is shown in FIG. 12 B. Thus when discharge cell A, the charge supply source, and discharge cell B, to which the discharge should be shifted, have applied simultaneously to electrodes y1 and y2 the shift pulse voltage $V_{sh}$, this same voltage pulse is also applied with the same polarity and phase to the opposing electrode x2, which defines the discharge cell D with the common electrode y1, which counteracts the voltage aplied to the common electrode y1. Therefore discharge cell D is placed in a neutral condition by having effectively no applied field, and as a result, the space charge generated by the discharge at cell A contributes more to discharge of cell B to which the discharge spot is to be shifted, in other words, the priming effect is increased. In FIG. 11, the upper and lower limits of the shift margin shown by the dotted lines $V_{US}$, and $V_{LS}$, are experimental data which is understood by this explanation. This indicates that a wide and uniform shift margin can be obtained in spite of variation in erase pulse width. The improved driving method shown in FIG. 10 can be attained easily by partly modifying the memory content of ROM 202 or 52, of FIGS. 5 or 7 respectively, and moreover it can also be realized with the circuit configuration shown in FIG. 13.

Figure 13:
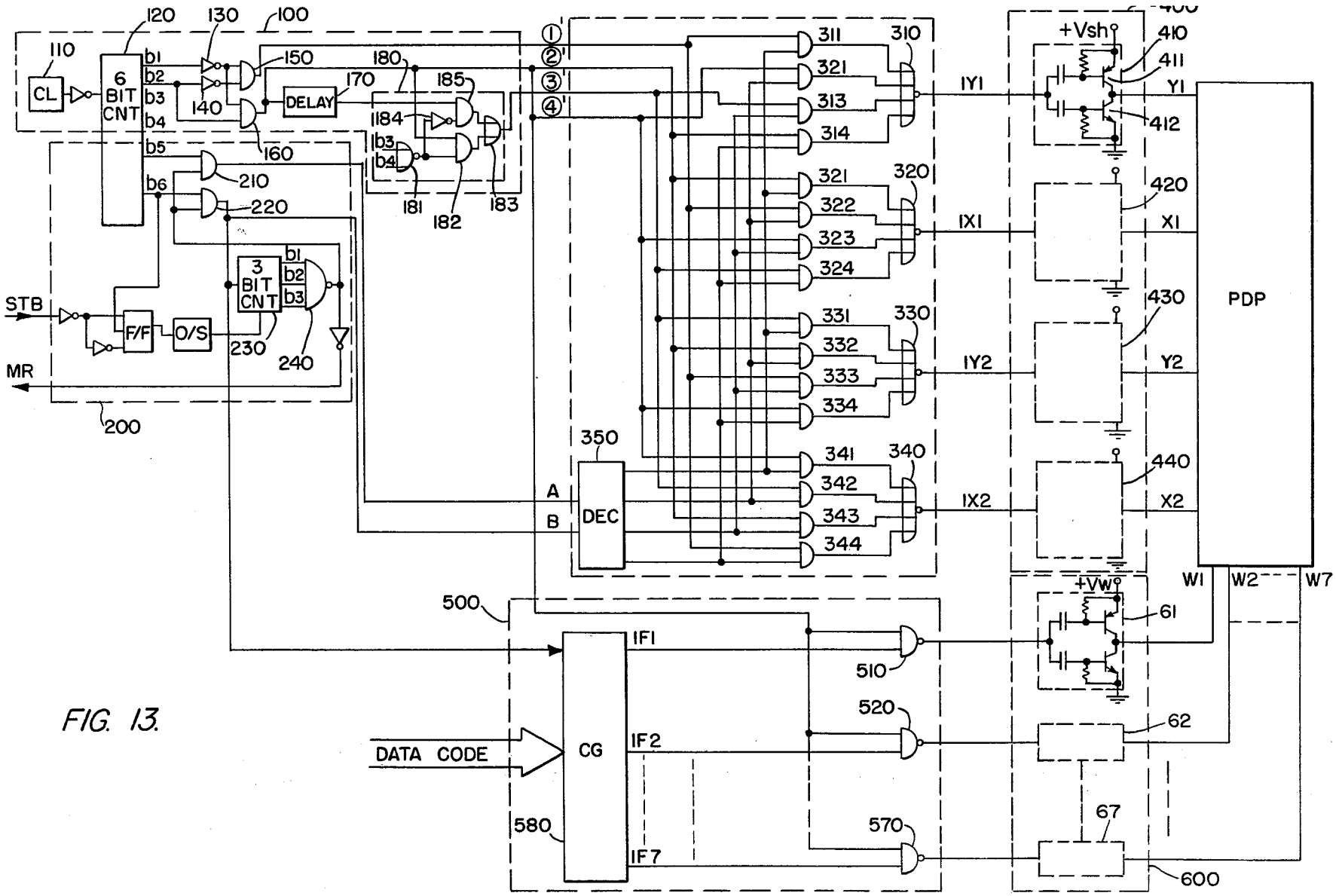
FIG. 13 shows in a block diagram a circuit configuration for generating the drive waveforms of FIG. 10.

The self-shift plasma display driving system shown in FIG. 13 comprises generally a basic timing signal generator circuit unit 100, a control signal generator circuit unit 200, a cycling circuit unit 300, a shift driver unit 400, a write signal generator circuit unit 500 and a write driver unit 600, each shown surrounded by broken lines. The basic timing signal generator circuit unit 100 controls the timing with which the above-described four basic pulse trains 1, 2, 3, and 4 shown in FIG. 10 are generated, and comprises essentially a binary 6-binary counter 120 which counts clock pulses from a clock pulse generator 110. The inverted output provided by the 1st and 2nd inventers 130 and 140 is applied to AND gate 150 which provides the 1st timing signal corresponding to the basic pulse train 1 on line 1' at every count of four clock pulses. The 1st bit inverted output and the 2nd bit output are applied to AND gate 160 which provides the 2nd and 4th timing signals corresponding to the basic pulse trains 2 and 4 respectively on lines 2' and 4'.

Thus four different signals, (a) the identical 2nd and 4th timing signals and (b) the delay signal obtained by feeding this to the delay circuit 170, and (c) the 3rd and (d) the 4th bit output signals of said 6-bit counter 120, are input to the phase switching circuit 180 to generate the 3rd timing signal corresponding to the above-mentioned basic pulse train 3 for the line 3'. In other words, when the 1st timing signal pulse is output onto the lines 2' and 4' during each unit period, with 16 clock pulses constituting one unit period, the timing signal pulse (corresponding to CP in FIG. 10) which is in the same phase as that on line 2' is output to line 3' via either the AND gate 182 or the OR gate 183 subject to the output "1" of NOR gate 181 being input the 3rd and 4th bit signals from the counter 120. However, in the pulse generation timing of the 3rd or succeeding pulses, since at least one output of the 3rd and 4th bit is in the high level, the signal in the same phase as the output on the line 2' is blocked by the AND gate 182 and during this period, the signal pulse (corresponding to EP in FIG. 10) which is delayed at the delay circuit 170 for the time delay corresponding to the erase pulse width is output to the line 3' via the other AND gate 185 which opens with the output of the inverter 184.

On the other hand, the control signal generating circuit unit 200 allows the 5th and 6th bit outputs of said bit counter 120 to pass AND gates 210 and 220 and supplies them to the 4-line decoder 350 of the cycling circuit unit 300 as the cycling signals A, B. The AND gates 210, 220 are controlled by the output via the NAND gate 240 of the 3-bit counter 230 which counts the 6th bit output of said 6-bit counter 120 and outputs the cycling switching signals A, B until it counts the output of said 6th bit up to 8. Namely,when writing letters with a 5 × 7 dot pattern, since the discharge cells of 4 groups are arranged periodically in the M type self-shift plasma display having the meander electrode structure as shown in FIG. 1, each cycle of shift operation has 4 unit periods, and therefore the pattern of one character can be written by cycling 5 times across 7 shift channels. If an inter-character space of 2 lines width is provided, the 8th cycle becomes the time for writing the next letter, and entry of this next letter is controlled by the output of said 3-bit counter 230.

When the 3-bit counter 230 counts up to 16, or in other words, when 8 cycles are completed each having 4 unit periods and each unit period corresponding to counting 16 clock pulses, the outputs of counter 230 become all "1", and the AND gates 210, 220 are closed by the output of NAND gate 240. At the same time, the next command MR for letter write operation is transferred.

The cycling circuit unit 300 comprises, also as in FIG. 4, 4 sets of 4 AND gates 311 to 314, 321 to 324, 331 to 334, 341 to 344, and 4 OR gates 310, 320, 330, and 340. To one input of each AND gate are connected the lines 1', 2', 3', 4' to respectively distribute the pulse trains, and to the other input of these gates the outputs of the 4-line decoder 350 corresponding to the cycling signals A, B are connected as shown in the figure. In addition, each OR gate output receiving the outputs of the AND gates is connected to the shift driver unit 400.

Since the output of the 4-line decoder 350 changes with each 16 clock pulses, corresponding to one unit period as described previously, the distribution sequence of the basic pulse trains is also sequentialy cycled at each unit period. Therefore, the four drivers 410, 420, 430 and 440 of the shift driver unit 400 are driven by the basic pulse trains as shown in FIG. 10, and the sequence for distribution to the four bus conductors Y1, X1, Y2, X2 of the self-shift type gas discharge panel PDP is changed every unit period. Each driver, as shown specifically only for driver 410, includes a pair of transistors, a pnp up-transistor 411 and the npn down-transistor 421 connected between the $+V_{sh}$ power supply and ground and being driven alternately by the common basic pulse trains, the shift voltage pulse being extracted from its neutral point as shown.

In the circuit of FIG. 13, the write signal generating circuit unit 500 is selected for the external letter code data signal and includes the character generator 580 which sequentially outputs the selected character pattern signal of 5 × 7 dots in units of one dot in every 4 unit periods for 7 shift channels and the AND gates 510 to 570 which match these outputs to the timing of basic pulse train 4. Then, the character pattern signals from these AND gates 510 to 570 are applied in parallel to write drivers 610 to 670 included in the write driver unit 600 and the write pulse of write voltage level +Vw is applied as shown in FIG. 10 to the write electrodes W1 to W7 corresponding to each shift channel of panel PDP. Thus, the data corresponding to the character pattern is sequentially written into 7 shift channels for each line, and the discharge spots generated thereby are each sequentially shifted along adjacent pairs of discharge cells by the above mentioned cycles of shift operation.

The shift operation of the above embodiment utilizes mainly plasma coupling due to space charge in the discharge gap area between the adjacent discharge cells. The mechanism of this plasma coupling, known as the priming discharge effect, is explained by the firing voltage of the non-firing cell adjacent to the firing cell being lower as a result of receiving a supply of space charge such as electrons, ions and meta stable atoms from the firing cell.

In the AC driven self-shift plasma display panel, the stabilization of the shift operation is enhanced not only by this discharge priming effect but also by the wall charge generated from the discharge. Since the adjacent discharge cells have alternately in common each end portion of each electrode in the M type self-shift panel having the meander electrode configuration shown in FIG. 1, the wall charge generated on the dielectric layer can be easily used for the shift operation. In order to use the wall charge in this manner, the shift pulse is applied to the discharge cell receiving the discharge spot with such polarity that the wall charge generated on the dielectric layer on the side of the cell having the electrode in common with the firing and receiving cells can help the shift operation. The positively charged ions are preferable as the wall charge to be used for the shift operation.

Figure 14:
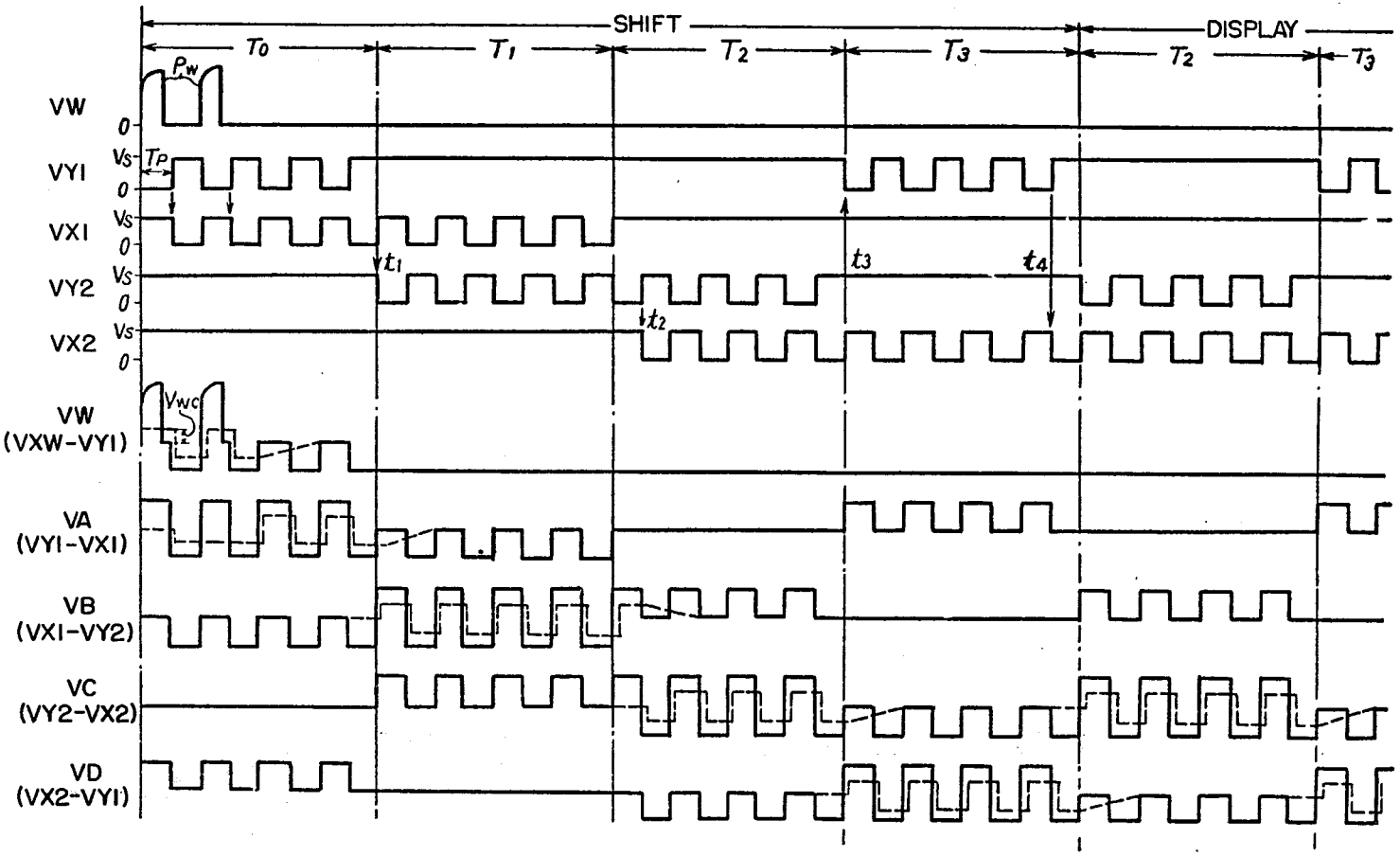
FIG. 14 shows a set of driving waveforms and resulting wall charge for the meander type self-shift discharge panel.

FIG. 14 is an example of driving signal waveforms for implementing the above mentioned shift operation in the M type self-shift panel, and the reference symbols correspond generally to those of FIGS. 2, 9 and 10. As shown in FIG. 14, each electrode normally has a constant positive shift voltage potential Vs applied from the corresponding bus conductors, and when the electrodes are put to ground potential to attract positive ions from the corresponding opposing common electrodes at each shift time t1, t2, t3, t4 (as indicated by the arrows), they are repetitively driven for a specified stabilizing period (four repetitions shown in each unit period).

In other words, referring also to FIG. 1 B, during the write or first unit period T0 in which driving waveform VY1 alternating from ground potential to Vs is supplied across electrode y11, a write pulse Pw is applied across write electrode w, causing a voltage such as VW shown in FIG. 14 to be applied across write discharge cell w, said voltage Vw developing a discharge accompanied with a wall voltage Vwc as shown by the dashed lines. During this unit period T0, a driving waveform such as VA is applied across discharge cell a1 adjacent to the write discharge cell w, the two cells having the electrode y11 in common. When the electrode x11 has voltage 0 and electrode y11 has voltage Vs, a positive wall charge of positive ions on the common electrode y11, produced as a result of the above write discharge, is then shifted to electrode x11, so that a shift discharge is aided by the wall voltage Vwx resulting from the write discharge to enhance a shift of the discharge to the discharge cell a1. One electrode x11, of the electrode portions defining this discharge cell a1, is in common with the next discharge cell b1 adjacent to said discharge cell a1. Consequently, when a voltage is applied across the next adjacent discharge cell b1 with timing t1 to permit a voltage Vs to be applied to the common electrode x11 and a voltage 0 to be applied to the opposite electrode y21, as shown in FIG. 14, when the common electrode x11 at the discharge cell al subsequently returns to voltage 0 and the opposite electrode y21 has a voltage Vs so that a discharge can take place, then the positive wall charge on the side of the common electrode x11 is attached to the electrode y21, thus helping the shift discharge to take place.

When a voltage pulse Vs of amplitude and of polarity to make the electrode x21 relatively negative (0), such as shown for driving waveform VC, is applied between the electrodes y21 and x21 defining the next adjacent discharge cell c1 at time t2, after alternating pulses are applied during period T1 for stabilizing the wall charges produced by the previous shift discharge, the positive wall charge developed at the common electrode y21 by the previous voltage pulse across the previous discharge cell b1 is then shifted to the electrode x21 and the shift discharge similarly occurs.

As described above, the shift operation shown in FIG. 14 is attained by applying the voltage pulse for shifting with such polarity that the wall charge, produced on the electrode which is in common to the discharge cell receiving the discharge spot, is attracted to the non-common electrode of said discharge cell for shifting the discharge thereto. Therefore, the shift voltage pulse at the shift timing must have a polarity opposite to that of the pulse voltage previously applied to the discharge cell (charge source cell) and there must be one electrode in common to shift the discharge spot.

The wall charge to be used for the shift operation may be positively charged ions or electrons, and when the erasing effect at the discharge cell which has already shifted the discharge spot is considered, it is preferably that ions should be used as described in the above embodiment. In other words, the wall charge remaining at the non-common electrode of the discharge cell which has shifted the discharge spot must be erased before a voltage pulse of a succeeding shift period is again applied through the buss conductors, and in this case, if the positive ions at the common electrode are used for the shift operation, consequently the wall charge remaining at the opposite non-common electrode are electrons with lighter mass than the positive ions and electrons can readily be neutralized and erased by the shift discharge of the adjacent discharge cell without any particular erase operation. However, in order to obtain the erase effect with greater accuracy, it is preferable to apply an erase pulse of short duration to the discharge cell which has shifted the discharge spot, and when this erase pulse is employed, a positive or negative wall charge can be used for the shift operation. In using electrons to form a negative wall charge, it is only necessary to supply a negative shift voltage pulse Vs sequentially through each bus conductor with each electrode otherwise placed to ground potential, oppositely to the waveforms shown in FIG. 14.

In accomplishing the shift operation of the discharge spot followed with the shift of the wall charge as described above, it is noted according to the waveforms of FIG. 14 that alternate shift pulses of several cycles are continuously applied to the discharge cell which has received the discharge spot. These trains of shift pulses are used for the purpose of stabilizing the wall charge produced by the shift discharge, and play a significant role in improving the shift operation margin.

As shown by experiment with a pulse width of 12 μsec at a frequency of 40 kHz, if the discharge spot received at one discharge cell is not stabilized by the proper alternative repetitive pulses discussed above, prior to being driven by a next shift pulse to shift the discharge to an adjacent discharge cell, the range of shift pulse voltage is only 2V between the upper and lower limits thereof. However, the interposition of a train of 4 cycles of alternating pulses enhances the voltage margin to about 10 volts, particularly by lowering of the lower limit of the operating range for shifting. This means that a single time discharge which takes place at the shift timing cannot produce a sufficient wall charge at the appropriate discharge cell, but that repetition of this discharge several times can produce a sufficient wall charge to permit a next opposite electrode to discharge and to thereby shift the discharge spot at a lower voltage.

Several major embodiments of this invention have been described above, and other modifications, embodiments and extensions will be obvious to a skilled worker in the art. For example, the features of each embodiment described above may be easily combined with each other or with an existing system or method. Moreover, this invention can be applied not only to the panel having the 2 by 2 phases of the meander type electrode structure as discussed above but also to the panel having a matrix electrode structure as described in U.S. Pat. No. 3,944,875, to panels having the parallel electrode structure described in U.S. Pat. No. 3,775,746, to other panels described in the previously cited co-pending U.S. Patent Applications Ser. Nos. 810,747 and 813,627, and to other scanning type electronic devices.

We claim:

1. A driving system for shifting discharge spots along adjacent discharge cells in a gas discharge panel, said driving system shifting said discharge spots in said panel by repeating a cycle of panel shift operation, each said cycle comprising a plurality of unit periods, said discharge cells being regularly arranged in said discharge panel, each of said cells being defined by a corresponding pair of electrodes, said electrodes being connected to a plurality of bus conductors, said driving system comprising:

first circuit means for generating a plurality of basic pulse trains in each unit period, selected predetermined sequences of said basic pulse trains defining corresponding selected driving waveforms, and second circuit means for cyclically distributing said basic pulse trains to each respective one of said bus conductors in corresponding ones of said predetermined sequences, whereby to provide respective driving waveforms to corresponding said bus conductors for each cycle of panel shift operation for shifting said discharge spots.

2. The system of claim 1, said first circuit means comprising:

memory means for storing bit data representing at least one unit period of each of said plurality of basic pulse trains, and reading means for repeatedly reading out the contents of said memory means to said second circuit means for providing said basic pulse trains for distribution by said second circuit means.

3. The system of claim 2 wherein said reading means comprises a counter for counting given increments of time to produce successive counter outputs, a predetermined plurality of said given increments of time defining a unit period, said memory means being responsive to said successive counter outputs to repeatedly provide said basic pulse trains.

4. The system of claim 1, said first and second circuit means comprise:

memory means for storing bit data representing each of said driving waveforms for said one cycle of panel shift operation; and reading means for reading out said driving waveforms during each said cycle of panel shift operation.

5. The system of claim 4 wherein said reading means comprises a counter for counting given increments of time to produce successive counter outputs, a predetermined plurality of said given increments of time defining said cycle, said memory means being responsive to said successive counter outputs to repeatedly provide said driving waveforms.

6. The system of claim 1 wherein said first circuit means comprises:

a clock source issuing clock pulses, a counter for counting the clock pulses to provide consecutive counter outputs corresponding to the number of clock pulses counted, and a logic circuit responsive to said consecutive counter outputs for providing corresponding consecutive logic outputs defining said plurality of basic pulse trains.

7. The system of claim 6, wherein said second circuit means comprises:

a second logic circuit responsive to said consecutive counter outputs for providing corresponding second consecutive logic outputs defining said predetermined sequences of said basic pulse trains, and gating means responsive to said second consecutive logic outputs for selectively providing respective basic pulse trains to corresponding bus conductors in accordance with said predetermined sequences.

8. The system of claim 1, wherein said second circuit means comprises:

a clock source issuing clock pulses, a counter for counting the clock pulse to provide consecutive counter outputs, a logic circuit responsive to said consecutive counter outputs for providing corresponding logic outputs defining said predetermined sequences of said basic pulse trains, and gating means responsive to said consecutive logic outputs for selectively providing respective basic pulse trains to corresponding bus conductors in accordance with said predetermined sequences.

9. A method for shifting discharge spots in a self-shift type of gas discharge panel by repeating a cycle of panel shift operation, each said cycle comprising a plurality of unit periods, said method comprising the steps of:

providing a plurality of adjacent discharge cells in said panel and a plurality of corresponding bus conductors;

repeatedly generating a plurality of basic pulse trains with predetermined relative phases in each unit period sequentially cycling said basic pulse trains to obtain a different distribution thereof in each unit period of said cycle, whereby to generate during said cycle corresponding different driving waveforms for shifting of said discharge spots; and supplying said different driving waveforms to respective said bus conductors during each said cycle, whereby to drive said discharge cells to shift said discharge spots across at least two of said adjacent discharge cells in each said cycle.

10. A method for shifting pairs of discharge spots along adjacent pairs of discharge cells in a self-shift type of gas discharge panel, said method comprising:

providing a regularly arranged plurality of discharge cells defined between opposing portions of a plurality of electrodes on each of two opposing substrates, each electrode on each substrate being in common to an adjacent pair of said discharge cells, each said pair of discharge cells having only one of said electrodes in common;

defining, for each given cell, a discharge cell adjacent thereto, a discharge receiving cell adjacent to said discharge cell, and an additional discharge cell adjacent to said dicharge receiving cell, said shifting comprising erasing of a discharge spot from said each given cell while spreading the discharge from said discharge cell to said discharge receiving cell;

applying a first voltage pulse of a given polarity to the electrode of said discharge receiving cell which is not in common with said discharge cell;

applying a second voltage pulse of said given polarity to the electrode of said discharge cell that is in common with said discharge receiving cell at a different time with respect to and not overlapping with said application of said first pulse;

applying a third voltage pulse of said given polarity to the electrode of said discharge cell that is in common with said given cell, the phase of said third positive pulse coinciding with the phase of said first positive pulse; and applying a fourth voltage pulse of said given polarity (1) to the electrode of said additional discharge cell opposing said electrode to which said first pulse is applied and (2) to the other electrode of said given cell opposing said electrode of said given cell to which said third pulse is applied, said applied fourth positive voltage pulse having a phase delay with respect to said first and third positive voltage pulses, whereby to produce a pair of erase pulses across said given cell and said additional discharge cell, respectively.

11. The method of claim 10, wherein each of said first, second, third and fourth pulses applied during said applying steps are of equal pulse width.

12. A method for shifting pairs of discharge spots along adjacent pairs of discharge cells in a self-shift type of gas discharge panel, said method comprising:

providing a regularly arranged plurality of discharge cells defined between opposing portions of a plurality of electrodes on each of two opposing substrates, each electrode on each substrate being in common to an adjacent pair of said discharge cells, each said pair of discharge cells having only one of said electrodes in common;

defining, for each given cell, a discharge cell adjacent thereto, a discharge receiving cell adjacent to said discharge cell, and an additional discharge cell adjacent to said discharge receiving cell, said shifting comprising erasing of a discharge spot from said each given cell while spreading the discharge from said discharge cell to said discharge receiving cell;

repeatedly applying a first voltage pulse of given polarity to the electrode of said discharge receiving cell which is not in common with said discharge cell;

repeatedly applying a second voltage pulse of said polarity to the electrode of said discharge cell that is in common with said discharge receiving cell, said application of said second pulse alternating with said application of said first pulse;

repeatedly applying a third voltage pulse of said polarity to the electrode of said discharge cell that is in common with said given cell, the phase of said third positive pulse coinciding with the phase of said first positive pulse; and repeatedly applying a fourth voltage pulse of said polarity (1) to the electrode of the additional discharge cell opposing said electrode to which said first pulse is applied and (2) to the other electrode of said given cell opposing said electrode of said given cell to which said third pulse is applied, at least each of said repeatedly applied fourth voltage pulses, except for the first of said applied fourth voltage pulses, having a phase delay with respect to said first and third voltage pulses, whereby to produce a pair of erase pulses across said each given cell and said additional cell, respectively.

13. The method of claim 12, wherein each of said repeatedly applied fourth voltage pulses has said phase delay.

14. The method of claim 12, wherein each of said first, second, third and fourth pulses repeatedly applied during said applying steps are of equal pulse width.

15. A method of shifting a discharge spot along adjacent discharge cells in a self-shift type of gas discharge panel, said method comprising:

providing a regularly arranged plurality of discharge cells defined between opposing portions of a plurality of electrodes on each of two opposing substrates, each electrode on each substrate being in common to an adjacent pair of said discharge cells, each said pair of discharge cells having only one of said electrodes in common;

defining, for each given cell, a receiving discharge cell adjacent to said given cell in the direction of said shifting, and an additional discharge cell adjacent to said receiving discharge cell in said direction;

applying a first voltage pulse of one polarity to the electrode in common to said receiving and additional discharge cells;

applying a second voltage pulse of said polarity to the electrode in common to said given and said receiving discharge cells at a different time with respect to and not overlapping with said application of said first pulse;

applying a third voltage pulse of said polarity to the other electrode of said given discharge cell, said application of said third voltage pulse having a first time delay with respect to said application of said second voltage pulse; and applying a fourth voltage pulse of said polarity to the other electrode of said additional discharge cell, said fourth voltage pulse having a second time delay with respect to said first voltage pulse.

16. The method of claim 15, wherein each of said first, second, third and fourth pulses applied during said applying steps are of equal pulse width.

17. A method for utilizing wall charge in shifting a discharge spot from a source discharge cell with a discharge spot to an adjacent receiving discharge cell not having a discharge spot in a self-shift type of gas discharge panel, said method comprising:

providing a regularly arranged plurality of discharge cells between opposing portions of a plurality of electrodes on each of two opposing substrates, each of said electrodes being covered with a dielectric layer, each electrode on each substrate being in common to an adjacent pair of said discharge cells, each said pair of discharge cells having only one of said electrodes in common;

defining a source discharge cell with a discharge spot and an adjacent receiving discharge cell not having a discharge spot;

applying a first voltage pulse of predetermined polarity across said source discharge cell to produce a wall charge of predetermined polarity on said dielectric layer covering said common electrode of said source discharge and receiving discharge cells; and applying a second voltage pulse of opposite polarity across said adjacent receiving discharge cell to shift said wall charge on said dielectric layer covering said common electrode to the other electrode of said receiving discharge cell.

18. The method of claim 17, wherein said wall charge of predetermined polarity produced on said dielectric layer covering said common electrode is a positive charge as a result of said first voltage pulse applied across said discharging cell being of negative polarity, and said second voltage pulse applied across said adjacent receiving cell being of a positive polarity.

19. The method of claim 17 wherein said applying steps comprise repeatedly applying said first and second voltage pulses, respectively.

* * * * *

UNITED STATES PATENT AND TRADEMARK OFFICE

CERTIFICATE OF CORRECTION

PATENT NO. : 4,132,924

DATED : January 2, 1979

INVENTOR(S) : HISASHI YAMAGUCHI ET AL.

It is certified that error appears in the above-identified patent and that said Letters Patent are hereby corrected as shown below:

* Col. 3, line 67, "cycle,," should be --cycle,--;
* Col. 5, line 43, "inventer" should be --inverter--;
  Col. 6, line 29, "3bit" should be --3-bit--;
* Col. 8, line 62, "accross" should be --across--;
  Col. 10, line 55, "aplied" should be --applied--;
* Col. 11, line 16, "inventers" should be --inverters--;
* Col. 12, line 22, "sequentialy" should be --sequentially--;
* Col. 14, line 19, "buss" should be --bus--;
* Col. 16, line 64, "dicharge" should be --discharge--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*